United States Patent [19]

Wilson

[11] 4,214,042

[45] Jul. 22, 1980

[54] TITANIUM BEARING MCRALY TYPE ALLOY AND COMPOSITE ARTICLES

[75] Inventor: Lloyd W. Wilson, Glastonbury, Conn.

[73] Assignee: United Technologies Corporation, Hartford, Conn.

[21] Appl. No.: 863,818

[22] Filed: Dec. 23, 1977

[51] Int. Cl.[2] ..... B32B 15/00

[52] U.S. Cl. ..... 428/678; 75/124; 75/171

[58] Field of Search ..... 75/171, 170, 124; 428/678, 679, 680, 682, 668

[56] References Cited

U.S. PATENT DOCUMENTS 4,054,723 10/1977 Higginbotham et al. ..... 75/171

*Primary Examiner*—R. Dean

*Attorney, Agent, or Firm*—Charles E. Sohl; Charles G. Nessler

[57] ABSTRACT

There are described MCrAlY type coating alloys having improved hot corrosion resistance, especially to sulfur and/or halide bearing compounds. In particular, improved hot corrosion resistance is achieved by the inclusion of about 1 to 12 weight percent titanium in the MCrAlY alloy composition.

5 Claims, 1 Drawing Figure

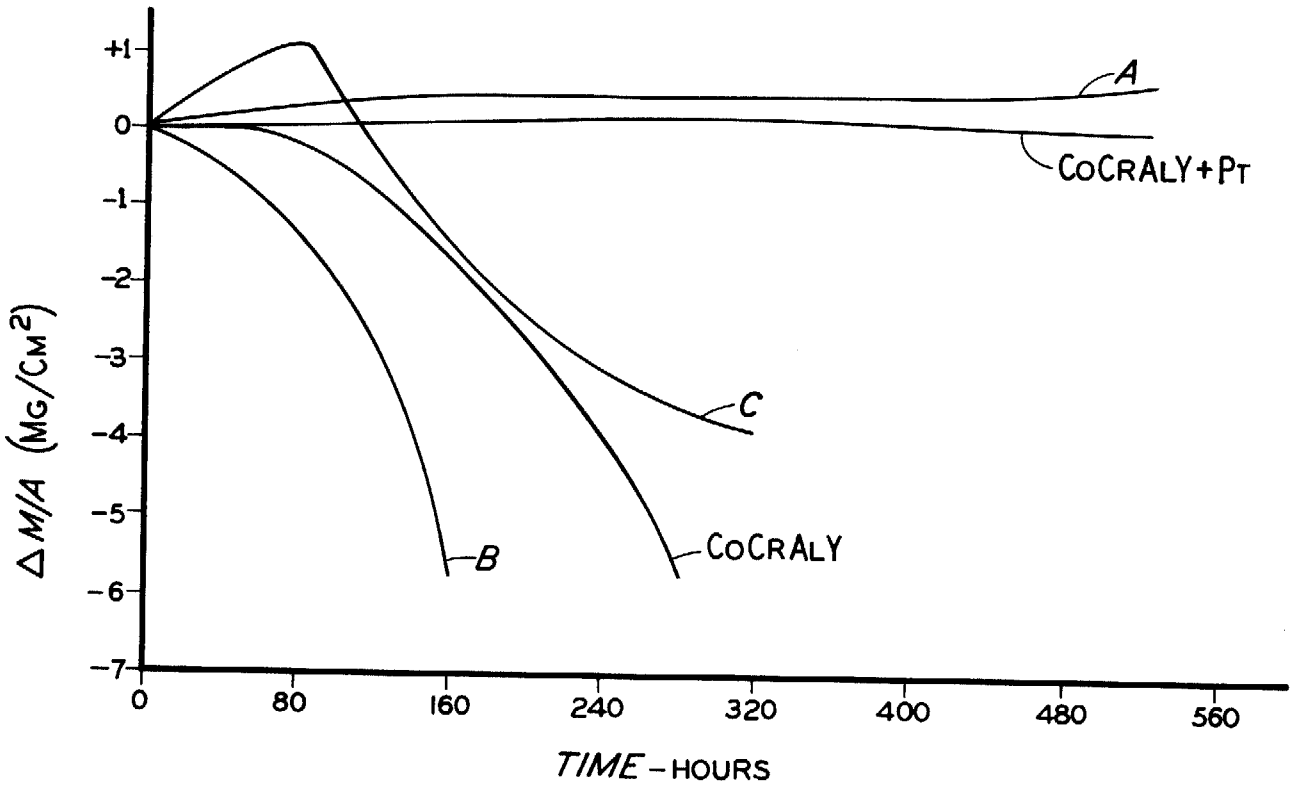
A
CoCrAlY+Pt
C
CoCrAlY
B
+1
0
-1
-2
-3
-4
-5
-6
-7
ΔM/A (Mg/cm²)
0
80
160
240
320
400
480
560
TIME-HOURS

TITANIUM BEARING MCRALY TYPE ALLOY AND COMPOSITE ARTICLES

BACKGROUND OF THE INVENTION

1. Field of the Invention

The present invention is directed to alloys having useful application as coatings for gas turbine engine components and, more particularly, to coating alloys of the MCrAlY type having improved hot corrosion resistance.

2. Description of the Prior Art

Modern gas turbine engine superalloys are known to be susceptible to oxidation-corrosion over a range of elevated temperatures. As a result, it is the usual practice to coat the superalloys with a protective alloy which is compositionally different from and more oxidation-corrosion resistant than the superalloy substrate.

A type of coating alloy widely used in gas turbine engine applications, such as blades and vanes, is the so-called MCrAlY alloy where M is iron, nickel, cobalt and mixtures thereof. Various forms of the MCrAlY alloy are described in the patents to Talboom et al, U.S. Pat. Nos. 3,542,530; Evans et al, 3,676,085; Goward et al, 3,754,903 and Hecht et al, 3,928,026. Although these coating alloys have proved highly successful in gas turbine engine environments, efforts have continued to improve their corrosion resistance to sulfur and/or halide bearing compounds at elevated temperature, such as 1200° F. to 1800° F., and above. A result of this work is the platinum bearing MCrAlY coating alloy of Felton, U.S. Pat. No. 3,918,139, of common assignee herewith.

SUMMARY OF THE INVENTION

The present invention contemplates MCrAlY type alloys having improved hot corrosion resistance, especially to sulfur and/or halide bearing compounds, by virtue of the inclusion of about 1 to 12 weight percent titanium in the alloy composition. A preferred embodiment of the invention particularly useful in gas turbine engine applications includes about 3 to 6 weight percent titanium.

BRIEF DESCRIPTION OF THE DRAWING

The FIGURE is a graph depicting hot corrosion behavior of alloys of the invention and a conventional CoCrAlY alloy and platinum bearing CoCrAlY alloy at 1650° F. in the presence of sulfur and chloride contaminants.

DESCRIPTION OF PREFERRED EMBODIMENTS

Although not so limited, the alloys of the present invention find particular utility in imparting hot corrosion resistance to superalloys, when utilized as coatings thereon, in the dynamic corrosive environment of gas turbine engines, especially those associated with marine and industrial use. The inventive alloys are in themselves corrosion resistant and do not depend for their protective effect upon a reaction with the substrate material.

In accordance with the invention, the hot corrosion resistance of MCrAlY type alloys can be markedly improved by the inclusion of about 1 to 12 weight percent titanium in the alloy composition. Preferably, the weight percent titanium is about 3 to 6. By way of illustration, three titanium bearing CoCrAlY alloys, along with a conventional CoCrAlY alloy and a platinum bearing CoCrAlY alloy, were tested for hot corrosion resistance by repeatedly thermally cycling alloy specimens for one hour at 1650° F. followed by a five-minute air cool. A contaminant (a 90% $Na_2SO_4$-10% Na Cl mixture) was applied to the specimens every twenty cycles in an amount of 1 mg/cm$^2$ in order to simulate a corrosive turbine engine environment, such as might be encountered in a marine or industrial gas turbine engine. The specimen weight was recorded as a function of time with the weight changes converted to weight gain or loss per unit surface area. The alloy compositions are tabulated herebelow while the hot corrosion behavior is shown in the FIGURE.

ALLOY COMPOSITION (weight percent)

| Alloy | Cr | Al | Y | Ti | Bal. |
|---|---|---|---|---|---|
| A | 16.2 | 11.7 | .55 | 5.1 | Co |
| B | 34.0 | 7.7 | .51 | 5.0 | Co |
| C | 23.6 | 7.3 | .62 | 10.9 | Co |
| CoCrAlY | 17.6 | 12.4 | .21 | — | Co |
| CoCrAlY + Pt | 17.3 | 12.2 | .23 | — | Co |

By comparing the behavior of alloy A with that of the conventional CoCrAlY alloy, it can be seen that the addition of 5.1 weight percent titanium to an otherwise standard CoCrAlY composition provides a considerably improved coating in this test. And, it is apparent that alloy A is substantially equivalent to the platinum bearing CoCrAlY alloy which heretofore has been considered to be the optimum MCrAlY alloy in terms of hot corrosion resistance. Thus, the present inventive alloys provide an opportunity for significantly reducing the cost of coating alloys (by eliminating platinum as an alloying ingredient) with no sacrifice in coating hot corrosion resistance. Of course, it is apparent that cost is a highly critical factor in selecting a coating for use in protecting gas turbine engine components which may number in the hundreds or thousands for a particular engine.

The behavior of alloys B and C in the hot corrosion tests illustrates that the effect of titanium additions is cumulative in that increasing amounts (5.0% Ti for alloy B versus 10.9% Ti for alloy C) provide increased hot corrosion resistance. it is also apparent from the behavior of these alloys as compared to that of the standard CoCrAlY alloy that the alloy aluminum content preferably should be at least about 9 weight percent regardless of the chromium content to achieve the full benefit from the titanium addition.

Of course, the base alloy composition to which titanium is added can vary depending upon the particular service environment to be encountered and the particular substrate to be coated. Generally, however, the MCrAlY-type base alloy includes substantial chromium, for example, at least about 10 weight percent; substantial aluminum, for example, at least about 7, preferably 9, weight percent and an effective amount of reactive metal selected from the group consisting of yttrium, scandium, thorium, lanthanum and other rare earth elements for purposes of promoting coating adherence, the balance of the composition being iron, nickel or cobalt or combinations thereof. A more preferred composition for the base alloy consists essentially of, by weight, about 10–40 weight percent chromium, about 9–25 weight percent aluminum and about 0.01–5.0 weight percent reactive metal for adherence. The MCrAlY-type alloys of the invention are characterized by excellent hot corrosion resistnace, especially to sulfur and/or halide bearing compounds at elevated temperatures in the range from about 1200° F. to 1800° F., and possibly higher.

When the alloys of the present invention are applied as coatings to iron, nickel and cobalt base superalloy substrates, such as turbine blades and vanes, articles of improved hot corrosion resistance are provided. Typical methods for applying the alloys of the invention onto superalloy substrates include, but are not limited to, vapor deposition, sputtering, plasma spraying and the like.

Although the invention has been shown and described with respect to typical examples and preferred embodiments, it should be understood by those skilled in the art that various changes may be made therein without departing from the spirit and scope of the invention.

Having thus described a typical embodiment of my invention, that which I claim as new and desire to secure by Letters Patent of the United States is:

1. A coated article having hot corrosion resistance comprising:

(a) a substrate selected from the group consisting of iron, nickel and cobalt base alloys; and (b) an MCrAlY type overlay alloy coating on said substrate, said coating consisting of by weight about 3–6 percent titanium, about 10–40 percent chromium, about 9–25 percent aluminum and about 0.01–5.0 percent reactive metal selected from the group consisting of yttrium, scandium, thorium and other rare earth elements, balance selected from the group consisting of nickel, cobalt and iron, said coated article having improved resistance to hot corrosion by virtue of the presence of titanium in the coating.

2. The coated article of claim 1 wherein the substrate is a gas turbine engine component.

3. The coated article of claim 2 wherein the component is a blade or vane.

4. An improved coating composition of the MCrAlY type consisting of by weight about 1–12 percent titanium, about 10–40 percent chromium, about 9–25 percent aluminum and about 0.01–5.0 percent reactive metal selected from the group consisting of yttrium, scandium, thorium and other rare earth elements, balance selected from the group consisting of nickel, cobalt and iron, said coating composition having improved resistance to hot corrosion by virtue of the presence of titanium.

5. The improved alloy of claim 4 wherein the weight percent titanium is about 3 to 6.

* * * * *